United States Patent [19]

Heyner

[11] 4,096,611

[45] Jun. 27, 1978

[54] APPARATUS FOR MOISTENING AND TEXTURING YARNS

[75] Inventor: Harald Heyner, Berlin, Germany

[73] Assignee: Heberlein Maschinenfabrik AG, Wattwil, Switzerland

[21] Appl. No.: 816,949

[22] Filed: Jul. 19, 1977

[30] Foreign Application Priority Data

Aug. 3, 1976 Germany ..... 2635341

[51] Int. Cl.[2] ..... D02G 1/20; D02C 1/16

[52] U.S. Cl. ..... 28/220; 28/273; 68/200

[58] Field of Search ..... 28/273, 272, 271, 217, 28/220; 68/200

[56] References Cited

U.S. PATENT DOCUMENTS

| | | | |
|---|---|---|---|
| 1,934,786 | 11/1933 | Friederick | 68/200 X |
| 3,892,020 | 7/1975 | Koslowski | 28/273 X |

*Primary Examiner*—Louis K. Rimrodt

*Attorney, Agent, or Firm*—Larson, Taylor and Hinds

[57] ABSTRACT

Apparatus for moistening and texturing yarns is described wherein yarns travel side-by-side over a surface into which bores, one for each yarn, open. Water under low pressure is delivered through the bores, the diameters of which are so adapted to the titers of the yarns that the yarns travelling over the bores exert a suction effect on the water and carry the water between the filaments in each yarn, without any additional layer of water enclosing the yarn, to a texturing nozzle. While passing through the nozzle loops or convolutions are formed in the individual filaments of the yarns by compressed air blown into a whirling chamber in the nozzle. The air is discharged from the nozzle, carrying the water away with it at the same end as the textured yarn, now substantially dry and formed from the non-textured yarns, emerges from the nozzle. The surface which is convexly curved and the bores with an inlet channel common to them are formed on a plug that fits into a holder connected by a tube to a water container.

9 Claims, 2 Drawing Figures

Fig. 1
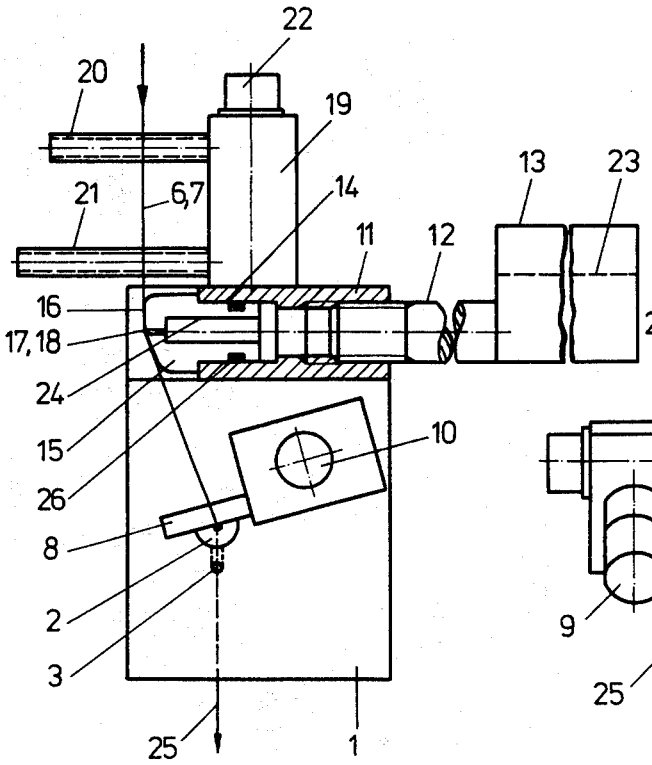
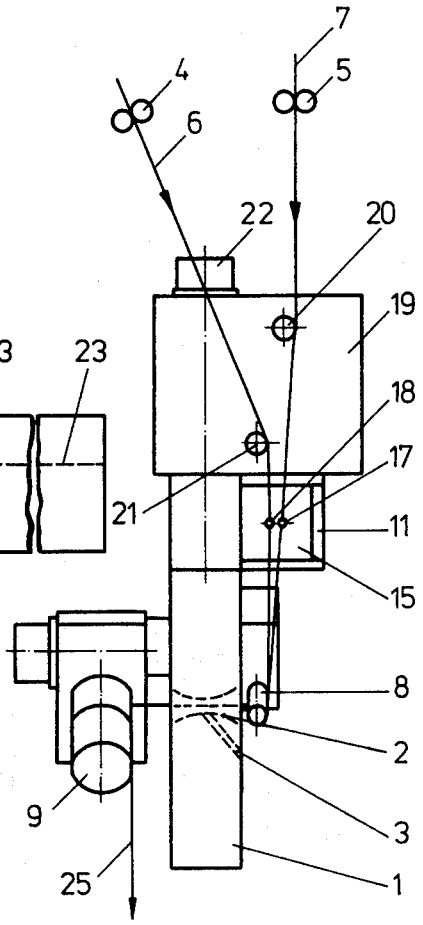
Fig. 2

APPARATUS FOR MOISTENING AND TEXTURING YARNS

FIELD OF THE INVENTION

The present invention relates to an apparatus for moistening and texturing one or several yarns consisting of a plurality of synthetic filaments or of native fibers or of mixtures of both.

DESCRIPTION OF THE PRIOR ART

In the textile industry, recently, to an increasing extent, not only yarns of natural materials, such as for example wool or cotton, but also of synthetic material, are used, the yarn consisting of a plurality of endless synthetic filaments which lie parallel to each other in the yarn.

Various methods are known by which a wool-like character can be imparted to such synthetic yarns by bulking them, i.e. by increasing their volume. For this purpose, it is known to use a so-called texturing nozzle through which the yarn is passed at an overfeed corresponding to the desired degree of texturing; the nozzle comprises a whirling chamber which is fed with a medium under pressure, for example air, to form loops and convolutions in the yarn by which the volume, i.e. the cross-section of the yarn, is enlarged and a wool-like character is imparted thereto. Such texturing nozzles are known in many embodiments. They always consist of a guiding channel for receiving the yarn to be textured which is followed by a whirling chamber in which loops or convolutions are formed in the yarn by the compressed air so that the textured yarn issuing from the whirling chamber has a volume enlarged due to loop formation. The yarn textured in this manner in the whirling chamber is carried out of the whirling chamber and removed by the air current to be wound up on a bobbin before being handed on for further processing.

It has been found that the formation of the loops or convolutions can be improved and accelerated optimally if the yarn to be textured is moistened with a liquid, usually water, before being fed to the texturing nozzle. Because of the more rapid formation of the loops or convolutions in moistened yarns, the texturing in the whirling chamber of the nozzle is effected in an essentially shorter time as a consequence of which the texturing nozzle can be operated with at least double the passage speed of the yarn.

In order to impart the necessary moistening to the yarn to be textured, consisting of synthetic filaments, it is known to arrange a liquid container upstream of the nozzle by which the yarn, before entering into the texturing nozzle, is passed so that it enters into contact with the water contained in the liquid container. For this purpose, the yarn is deviated over guiding bars at an acute angle, the vertex of which is formed by a guiding bar situated below the level of the water bath. This guiding of the yarn through the water bath is disadvantageous insofar as the yarn excessively absorbs water. Not only the spaces existing between the individual filaments of the yarn are filled with water, but cohesion causes the formation of an additional layer of water enclosing the yarn, which must be removed before the yarn enters the nozzle. This is effected on the one hand by detaching a part of the excessive water at the deviation elements provided upstream of the texturing nozzle, by projecting the water away and on the other hand by causing a further part of the excess of water to be poured away in the narrower guiding channel situated upstream of the whirling chamber. Since the guiding channel in the nozzle, for easily understandable reasons, must have a larger although only slightly larger, diameter than the yarn, always a remainder of the excessive water reaches the whirling chamber wherein it is detached by the current of air and must be removed from the whirling chamber together with the air. This excess of water has therefore disturbing effects outside the nozzle as well as in the whirling chamber and leads to excessive water precipitation on the apparatus used for yarn treatment.

SUMMARY OF THE INVENTION

It is the purpose of the present invention to avoid the above-mentioned disadvantage in a device including a texturing nozzle and a liquid container arranged upstream of the nozzle, intended for moistening the yarn, and to dispose and form the liquid container serving to moisten the yarn in such a manner that, during moistening the yarn, the absorption of an excess of water is avoided and that the yarn only absorbs enough water in the wetting device to fill the spaces existing beween the individual filaments of the yarn with water, while the formation of a coating of water enclosing the yarn, which must be removed again, is avoided.

According to the present invention, this problem is resolved by a liquid container having a member the surface of which defines the path of the yarn, the front surface of the member comprising a number of bores over which the yarns pass and which corresponds to the number of yarns to be fed to the nozzle, the bores being fed with liquid from the liquid container, and their diameter being so adapted to the titer of the yarns that the yarns passing over the bores exert a suction effect on the liquid in the bores. Due to the fact that each travelling yarn is guided over a bore situated upstream of the texturing nozzle and is fed from the water container, the bore being adapted to the titer of the yarn, the direct contact with a water bath that has been necessary up to now is avoided, and the travelling yarn, due to the suction effect produced by its movement, only absorbs enough water from the bore for the spaces between the filaments of the yarn to be filled with water, without the possibility of an additional coating of water being created around the yarn. In this manner, projection or stripping-off of excessive water from the yarn before it enters the texturing nozzle is avoided, and only the water absorbed between the filaments of the yarn is removed in the whirling chamber by blowing off the water. Therefore the textured yarn emerges from the texturing nozzle substantially dry.

Advantageously the level of the liquid in the container is sufficiently high for the liquid fed to the bore to be under slight static pressure. The low static pressure under which the water is presented to the surface of the member over which the yarn passes, ensures that disruption of the water film in the bore by the suction effect of the yarn is avoided and a continuous and uniform wetting of the yarn results. This static pressure depends on the kind and the travelling speed of the yarn and may, as a rule, amount to between 10 and 100 mm water gauge.

Very conveniently the yarn may be guided centrally over the bores by means of guiding bars disposed on both sides of the bores. The guiding bars ensure that each yarn is always guided centrally over its respective bore without any fluttering movements, whereby uniform wetting is assured.

It is convenient for the bore or each bore to lead from a wider channel in the said member. If several yarns consisting of filaments are simultaneously processed in the texturing nozzle, the bores associated respectively with the yarns lead from the front face of a common channel whereby an equal distribution of water to all the bores is ensured.

The said member may be in the form of a plug which can be fitted and sealed into a holder connected to the liquid container. The shaping of the plug as a removable fitting makes it possible to change the member easily if the number of yarns (for example one, two or three) to be fed to the texturing nozzle simultaneously is to be altered.

It is highly desirable for the plug to have a convexly curved front surface which, if necessary, may be provided additionally with a thread-guide groove. The yarn to be textured is guided by the convex curve of the front surface over the bore practically without deviation and without danger of damage.

It is furthermore important that the plug should consist of non-corrosive material. This measure prevents the bore in the front surface of the plug from being obstructed by corrosion.

Obviously also the front surface of the plug should be wear-resistant. Therefore, the front surface of the plug may be coated with a wear-resistant coating which prevents the travelling yarn from cutting into the front surface of the plug.

DESCRIPTION OF THE DRAWINGS

In order that the invention may be clearly understood and readily carried into effect, one construction in accordance therewith will now be described, by way of example, with reference to the accompanying drawings, in which:

FIG. 1 shows a lateral elevation of apparatus, partially in cross-section, for use in moistening and texturing textile yarn; and FIG. 2 shows a front elevation of the apparatus of FIG. 1.

Referring to the drawings, in a support plate 1, a known air texturing nozzle 2 is provided, the whirling chamber of which is fed with compressed air through a bore 3 inclined so that the air is discharged at one end of the nozzle. Referring to FIG. 2, in the texturing nozzle 2, two yarns 6, 7 are simultaneously textured, these yarns being fed to the nozzle 2 by delivery devices 4, 5 with overfeed. The yarn leaves the nozzle at the same end as the air stream.

Upstream of the texturing nozzle 2, there is provided a deviation pin 8 over which the two yarns 6, 7 are introduced into the nozzle. A yarn 25 formed of the two yarns 6, 7 is removed from the texturing nozzle 2 by way of a guiding element 9 and fed to a bobbin (not shown). The deviating pin 8 and guiding element 9 are rotatable around an axis 10 so that they can be adjusted exactly centrally with respect to the texturing nozzle 2.

On the plate 1, there is arranged, ahead of the texturing nozzle 2, a holder 11 which is connected by a tube 12 with a liquid container 13 containing water. At its front end, the holder 11 is formed with a bore of enlarged diameter into which a plug 15 can be inserted which has a convexly curved front surface 16. The plug has a sealing ring 26 so that it can be inserted tightly into the bore 14 of the holder 11. On the front surface 16 of the plug 15, there are arranged two bores 17, 18 beside each other over which the yarns 6, 7 pass. The bores 17, 18 lead from a common channel 24 in communication with the tube 12. In order to ensure exactly centrical guiding of the yarns 6, 7 over the bores 17, 18, a plate 19 on which two guiding pins 20, 21 are fixed, is arranged above the holder 11. By means of an adjusting element 22, the guiding pins 20, 21 can be adjusted so that the yarns guided over the deviation pin 8 respectively pass centrally over the bores 17, 18 in the front surface 16 of plug 15. In the water container 13, the water level 23 is adjusted so that the water in the bores 17, 18 is under low static gauge pressure (10 to 100 mm water gauge). The front surface 16 of the plug 15, as particularly shown in FIG. 1, so engages the yarns 6, 7 that they are maintained in contact with the front surface 16.

The diameters of the bores 17, 18 are so adapted to the titers of the yarns passing thereover that when the yarns 6, 7 are fed to the texturing nozzle 2, they absorb a quantity of water because of the suction effect due to their speed over the bores 17, 18. The spaces between the filaments of the yarns 6, 7 are thereby filled with water but without any additional layer of water enclosing the yarn. The low static gauge pressure on the water in the bores 17, 18 results in uninterrupted feeding of the water. The yarns 6, 7 moistened by water from the bores 17, 18 enters the texturing nozzle 2 after passing partially round the deviation pin 8. In the texturing nozzle, loops or convolutions in the individual filaments of the yarn 6, 7 are formed by compressed air fed into the whirling chamber and the compressed air blows the water off the loops or convolutions through the texturing nozzle 2, the water being removed with the compressed air leaving the texturing nozzle in the direction of the yarn travel so that, beyond the texturing nozzle 2, a dry, textured yarn 25 is formed from the non-textured yarns.

The surface 16 may be formed with grooves for the yarns and the plug 15 is made of non-corrosive material and may be made wear-resistant for example by chromium-coating or by tempering.

I claim:

1. Apparatus for moistening and texturing at least one yarn consisting of filaments and travelling lengthwise through the apparatus, the apparatus comprising texturing nozzle means formed with a nozzle arranged for the yarn to pass therethrough, said nozzle means being adapted to form loops, or convolutions in filaments in yarn while travelling through said nozzle, delivery and guiding means for determining the path of the yarn prior to entering said nozzle and after leaving said nozzle, a member mounted in position for the yarn to pass thereover prior to entering said nozzle, said member being formed with a convexly curved surface and located for the yarn to slide thereover along a curved path while travelling towards said nozzle and said member being formed with at least one bore opening into said curved surface in said path, and means for feeding liquid through said bore, the diameter of said bore being adapted to the titer of the yarn whereby the yarn travelling over said bore exerts a suction effect on the liquid and carries the liquid between its filaments of said nozzle.

2. Apparatus according to claim 1, in which said means for feeding liquid through said bore comprises a container and tubular means connecting a lower portion of said container to said bore whereby a head of liquid can be maintained in said container to maintain a low static pressure in said bore.

3. Apparatus according to claim 2, in which said member is constituted by a plug detachably inserted tightly into the end of said tubular means remote from said container.

4. Apparatus according to claim 1, in which said surface is formed with a groove to be traversed by the yarn when passing over said surface.

5. Apparatus according to claim 1, in which said member is made of corrosion resisting material.

6. Apparatus according to claim 1, in which said member comprises a wear-resistant coating presenting said surface.

7. Apparatus for moistening and texturing a plurality of yarns, each consisting of filaments and travelling lengthwise through the apparatus, the apparatus comprising texturing nozzle means formed with a nozzle arranged for the yarns to pass simultaneously therethrough, said nozzle means being adapted to form loops or convolutions in filaments in yarns while simultaneously travelling through said nozzle, guiding means for determining the paths respectively of the yarns prior to entering said nozzle, guiding means for determining the path of a dry, textured yarn leaving said nozzle after being formed from the yarns entering said nozzle, a member mounted in position for the yarns to pass thereover prior to entering said nozzle, said member being formed with a surface shaped and located for the yarns to slide thereover respectively along predetermined paths while travelling towards said nozzle and said member being formed with bores opening into said surface respectively in the paths of the yarns, and means for feeding liquid through said bores, the diameters of said bores being adapted to the titers of the yarns whereby each yarn travelling over its respective bore exerts a suction effect on the liquid and carries the liquid between its filaments to said nozzle.

8. Apparatus according to claim 7, in which said guiding means for determining the paths respectively of the yarns prior to entering the nozzle comprise guiding members allocated respectively to the yarns and located to be traversed by the yarns prior to reaching said bores and a further guiding member located so as to guide the yarns after passing said bores into said nozzle.

9. Apparatus according to claim 2, in which said member is formed with a channel of substantially greater cross-section than each of said bores and having an otherwise closed end from which said bores lead to said surface, the opposite end of said channel being open to receive the liquid.

* * * * *